United States Patent [19]

Jones

[11] Patent Number: 4,631,086

[45] Date of Patent: Dec. 23, 1986

[54] CONCENTRATED COMPOSITIONS FOR COATING CORRUGATED BOARD

[75] Inventor: James C. Jones, Maumee, Ohio

[73] Assignee: Owens-Illinois, Inc., Toledo, Ohio

[21] Appl. No.: 751,770

[22] Filed: Jul. 2, 1985

[51] Int. Cl.[4] ..... C09K 3/14; B32B 5/16

[52] U.S. Cl. ..... 106/36; 428/331; 428/452; 428/537.5

[58] Field of Search ..... 106/36, 300 N

[56] References Cited

U.S. PATENT DOCUMENTS

| | | | |
|---|---|---|---|
| 3,860,431 | 1/1975 | Payne et al. | 106/36 |
| 3,901,987 | 8/1975 | Payne et al. | 106/36 |
| 4,418,111 | 11/1983 | Carstens | 106/36 |
| 4,452,723 | 6/1984 | Carstens | 106/36 |

*Primary Examiner*—Theodore Morris

*Attorney, Agent, or Firm*—John R. Nelson

[57] ABSTRACT

Concentrated aqueous solutions of at least about 20 wt. % of finely divided silica and at least about 15 to 20 wt. % urea are coated on corrugated board effectively and easily by sponging, the coating having non-skid properties, the quality of printing being enhanced and warp being reduced.

17 Claims, No Drawings

CONCENTRATED COMPOSITIONS FOR COATING CORRUGATED BOARD

The present invention relates to improved concentrated coating compositions for coating corrugated board.

In the past, generally dilute aqueous solutions of colloidal silica and urea for non-skid surface compositions for paper products, especially paperboard containing recycled paper fibers, are disclosed in U.S. Pat. Nos. 4,418,111 and 4,452,723 Carstens (assigned to Key Tech Corporation).

For corrugated board, there has been a need for aqueous compositions that can be applied to the board by sponges and compositions that will not deteriorate after exposure to a freeze-thaw cycle while still maintaining non-skid properties and not adding to warp and printing problems.

It is an object of the present invention to provide a concentrated aqueous coating composition solution of colloidal silica and urea that can be applied to corrugated board by sponging and the solution is stable even through four freeze-thaw cycles.

It is an object of the present invention to provide a concentrated coating composition for coating corrugated board to reduce warp, enhance print quality and provide non-skid properties to the board, the composition comprising a mixture of: (a) about 20 to 40 wt. % of finely divided silica having an average particle size of about 0.01 to 1 micron; (b) about 20 to 40 wt. % of urea; and (c) about 20 to 60 wt. % of water, the weight ratio of silica/urea being about 0.5/1 to about 2.75/1; the composition being stable against premature gelling due to heat or cold and being stable through at least four cycles of freezing and thawing.

It is an object of the present invention to provide a concentrated aqueous coating composition of colloidal silica and urea, the silica and urea being heated to about 140° F. to 170° F. to form the coating solution that reduces warp, enhances printing quality, and maintains non-skid properties.

It is an object of the present invention to provide a concentrated composition for coating corrugated board simply and effectively by sponging, the coating composition comprising a concentrated aqueous solution of colloidal silica and urea, the coating reducing warp, enhancing print quality and providing non-skid properties for the board.

It is an object of the present invention to provide a method of making and using a coating composition for corrugated board conveniently by sponging, the coating composition being a concentrated aqueous solution of colloidal silica and urea.

It is an object of the present invention to provide a concentrated aqueous coating solution of colloidal silica and urea for coating corrugated board, the coating being made by heating the silica and urea to about 140° to 170° F., the resulting coating providing non-skid properties to the board, reducing warp and enhancing print quality; the concentrated solution capable of withstanding at least four cycles of freeze-thaw.

These and other objects will be apparent from the specification that follows and the appended claims.

The present invention provides a concentrated coating composition for coating corrugated board to reduce warp, enhance print quality and provide non-skid properties to the board, the composition comprising a mixture of: (a) about 20 to 40 wt. % of finely divided silica having an average particle size of about 0.01 to 1 micron; (b) about 20 to 40 wt. % of urea; and (c) about 20 to 60 wt. % of water, the weight ratio of silica/urea being about 0.5/1 to about 2.75/1; the composition being stable against premature gelling due to heat or cold and being stable through at least four cycles of freezing and thawing.

The present invention provides a method of making a concentrated coating composition for producing non-skid corrugated board to reduce warp and improve the printing quality thereof, the method including mixing (a) about 20 to 40 wt. % of finely divided silica, (b) about 20 to 40% urea, and (c) about 20 to 60 wt. % water to provide a stable concentrated coating solution that does not gel prematurely due to heat or cold and is stable through at least about four cycles of freezing and thawing.

In the above coating composition and method of making it, the weight ratio of silica to urea is generally about 0.75/1 to 1.75/1 and preferably about 0.95/1 to 1.5/1. More preferably, the weight ratio of silica to urea is about 1/1 to 1.25/1.

In general the finely divided silica is colloidal silica usually in a solution of about 25 to 60 wt. % solids in water, the preferred amount being about 40 to 50 or 55 wt. %. The particle size of the finely divided silica is generally about 0.01 to 1 micron, preferably about 0.02 to 0.1 micron and more preferably about 0.020 to 0.025 micron, excellent results being obtained with an average particle size of about 0.022 micron. Urea is used in the mixture to form the concentrated solution, the urea generally being about a 20 to 60 wt. % solids solution in water, the preferred amount being about 35 to 40 up to 45 or 50 wt. % solids.

In another embodiment, the concentrated solution preferably contains about 30 to 70 wt. % finely divided silica, about 15 to 40 wt. % urea, and about 4 to 15 wt. % water, the more preferred amounts being about 60 to 65 wt. % silica, 28 to 32 wt. % urea, and 5 to 9 wt. % water. Excellent results in this embodiment are obtained using about 63 wt. % silica, 7 wt. % water and 30 wt. % urea. Excellent results are also obtained by about 62.8 parts by weight of finely divided silica, 31.1 parts urea and 6.8 parts water. In this embodiment, the finely divided silica and urea in a water solution are advantageously heated to generally about 140° F. to 170° F., preferably about 145° to 160° F., and optimally about 148° to 150° F. to provide a stable product that provides non-skid properties to corrugated board, enhancing printing qualities and reducing warp. The heated concentrated solution is stable against gelling due to heat or cold and can withstand at least about four cycles of freezing and thawing.

In the heated embodiment, the weight ratio of silica is generally about 1.25/1 to 2.5/1, more preferably about 1.75/1 to 2.25/1 and optimally about 1.9/1 to 2/1.

The following concentrated solutions provided the benefits of the present invention, reducing warp, enhancing print quality and providing non-skid properties to the board.

| Ingredient | Wt. % |
|---|---|
| Concentrated Solution | |
| Finely divided silica (colloidal) | 30 |
| Urea | 30 |

-continued

| Ingredient | Wt. % |
|---|---|
| Water | 40 |
| Heated (150° F.) Concentrated Solution | |
| Finely divided silica | 62.8 |
| Urea | 31.2 |
| Water | 7 |

The above concentrated coating solutions were subjected to four freeze-thaw cycles and there was no premature gelling.

One of the preferred finely divided silica material is a colloidal silica such as LUDLOX TM colloidal silica sold by DuPont. The alkaline colloidal silica generally has a pH of about 7 to 11 and preferably 8 or 9 to 10.

A suitable finely divided silica is a fumed (vapor deposited) silica such as CAB-O-SIL TM silica sold by Cabot. The concentrated aqueous solutions, say 10 to 15 wt. % or more have a pH of about 4 or 3.9 down to 3.5 or 3.2. The solutions can be made alkaline (pH of more than 7) or more alkaline than, say 3.2 or 3.5 by the addition of NaOH. As is known, the gel formation, or coagulation, depends upon factors such as concentration, particle size, and pH. It is believed that a siloxane bond is formed to hold silica particles together and that the siloxane reaction is catalyzed by hydroxyl ions. At a pH of about 3.2 to 3.5 or 4, there apparently are few hydroxyl ions present to catalyze the reactions that lead to gel formation and, hence, the sol is semistable. In plotting pH against gel time (stability), the pH of about 5 or 6 indicates about a maximum gelling rate.

Suitable sources of the finely divided silica are NAKCIAG TM silica sols sold by Nalco Chemical Company, the silica sols having a pH from about 3.2 to 3.5 or 4 as well as alkaline sols having a pH of more than 7. NALCOAG TM silica sols are described in a technical bulletin headed Technifax, Specialty Chemicals TF109, 1978.

A suitable alkaline colloidal silica having a pH of 9.1 is described in a duPont technical bulletin LUDLOX TM CL-X colloidal silica.

In addition to the great advantages obtained in frictionizing corrugated board, the freeze-thaw stable compositions can be used for sizing textiles, for lost wax investment castings, and for protective coatings.

What is claied is:

1. A concentrated coating composition for coating corrugated board to reduce warp, enhance print quality and provide non-skid properties to the board, the composition comprising a mixture of:

(a) about 20 to 40 wt. % of finely divided silica having an average particle size of about 0.01 to 1 micron;

(b) about 20 to 40 wt. % of urea; and (c) about 20 to 60 wt. % of water, the weight ratio of silica/urea being about 0.5/1 to about 2.75/1, the composition being stable against premature gelling due to heat or cold and being stable through at least 4 cycles of freezing and thawing.

2. A composition as defined in claim 1 in which the weight ratio of silica/urea is about 0.5/1 to 2/1.

3. A composition as defined in claim 1 in which the weight ratio of silica/urea is about 0.75/1 to 1.75/1.

4. A composition as defined in claim 1 in which the weight ratio of silica/urea is about 0.95/1 to 1.5/1.

5. A composition as defined in claim 1 in which the average particle size of the silica is about 0.02 to 0.1 micron.

6. A composition as defined in claim 1 in which the average particle size of the silica is about 0.020 to 0.025 micron.

7. A composition as defined in claim 1 in which the amount of silica is about 30 wt. %, the amount of urea is about 30 wt. % and the amount of water is about 40 wt. %.

8. A concentrated composition for coating corrugated board efficiently by sponging, the coating composition providing non-skid properties to the board as well as reducing warp and enhancing the printing qualities of the board, the composition comprising:

(a) about 30 to 70 wt. % of finely divided silica;

(b) about 15 to 50 wt. % of urea; and (c) about 4 to 15 wt. % of water;

the silica, urea and water being mixed and heated from about 140° F. to 170° F. to form a concentrated coating solution that is stable and does not gel prematurely due to heat or cold, the solution being stable through at least about four cycles of freezing and thawing.

9. A composition as defined in claim 8 in which the temperature of heating is about 145° to 160° F.

10. A composition as defined in claim 8 in which the temperature of heating is about 148° to 150° F.

11. A composition as defined in claim 8 in which the weight ratio of silica to urea is about 1.25/1 to 2.5/1.

12. A composition as defined in claim 8 in which the weight ratio of silica to urea is about 1.9/1 to 2/1.

13. A composition as defined in claim 8 in which the composition has about 62.8 wt. % silica, about 31.2 wt. % urea, and about 7 wt. % water.

14. A composition as defined in claim 8 in which the average particle size of the silica is about 0.01 to 0.1 micron.

15. A method of making a concentrated coating composition product that can easily be coated onto corrugated board by sponging, the coating composition reducing warp, improving print quality and providing non-skid properties to the board, the method comprising the steps of:

(A) mixing about 30 wt. % to 70 wt. % of finely divided silica having an average particle size of about 0.01 to 0.1 micron; about 15 to 40 wt. % of urea; and about 4 to 15 wt. % water to form a mixture; and (B) heating the mixture at about 140° F. to 170° F. to provide a concentrated coating composition that does not gel prematurely due to heat or cold.

16. A method as defined in claim 15 in which the temperature in step (B) is about 150° F.

17. A method as defined in claim 15 in which the heating is at about 145° F. to 160° F. and the composition is stable through at least about four cycles of freezing and thawing.

* * * * *

UNITED STATES PATENT AND TRADEMARK OFFICE

CERTIFICATE OF CORRECTION

PATENT NO. : 4,631,086

DATED : December 23, 1986

INVENTOR(S) : James C. Jones

It is certified that error appears in the above-identified patent and that said Letters Patent are hereby corrected as shown below:

Col. 3, line 14, "LUDLOX" should be --LUDOX--.

Col. 3, lines 33 and 34, "NAKCIAG" should be --NALCOAG--.

Col. 3, lines 41 and 42, "LUDLOX" should be --LUDOX--.

Signed and Sealed this

Seventh Day of April, 1987

*Attest:*

DONALD J. QUIGG

*Attesting Officer*

*Commissioner of Patents and Trademarks*